United States Patent [19]

Roeder

[11] 4,183,722

[45] Jan. 15, 1980

[54] DOWNHOLE JET PUMPS

[76] Inventor: George K. Roeder, P.O. Box 4335, Odessa, Tex. 79760

[21] Appl. No.: 803,977

[22] Filed: Jun. 6, 1977

[51] Int. Cl.[2] ..... F04F 5/00

[52] U.S. Cl. ..... 417/172; 166/106

[58] Field of Search ..... 166/106; 417/151, 167, 417/170, 172, 185, 76, 84, 89, 174

[56] References Cited

U.S. PATENT DOCUMENTS

| | | | |
|---|---|---|---|
| 121,376 | 11/1871 | Jamison | 417/151 |
| 636,333 | 11/1899 | Guethler | 417/174 X |
| 801,641 | 10/1905 | Boetcher | 417/174 |
| 1,055,210 | 3/1913 | Morison | 417/170 X |
| 1,228,608 | 6/1917 | Scanes | 417/197 X |
| 1,258,418 | 3/1918 | Kemble | 417/172 |
| 1,372,149 | 3/1921 | Lang | 417/170 |
| 1,372,150 | 3/1921 | Lang | 417/170 |
| 1,548,029 | 8/1925 | Ehrhart | 417/170 |
| 1,642,121 | 9/1927 | McMahon | 417/76 |
| 1,782,310 | 11/1930 | Overstreet | 417/172 X |
| 1,992,436 | 2/1935 | McMahon | 417/76 |
| 2,080,623 | 5/1937 | McMahon | 417/172 X |
| 2,114,905 | 4/1938 | McMahon | 417/172 |
| 2,187,486 | 1/1940 | Burt | 166/106 X |
| 2,191,717 | 2/1940 | Jeffery | 417/151 |

FOREIGN PATENT DOCUMENTS

| | | | |
|---|---|---|---|
| 1160602 | 1/1964 | Fed. Rep. of Germany | 417/151 |
| 735866 | 8/1955 | United Kingdom | 417/84 |

*Primary Examiner*—Carlton R. Croyle
*Assistant Examiner*—Edward Look
*Attorney, Agent, or Firm*—Marcus L. Bates

[57] ABSTRACT

A jet pump for use downhole in a borehole for producing fluid from the wellbore by employment of a power fluid supplied from the surface of the ground. The power fluid flows through the jet pump assembly to cause a pumping action. The jet pump includes a suction chamber formed about a nozzle. The nozzle is spaced from a venturi throat. The venturi throat diverges in a direction away from the nozzle. A deflecter has one end supported by the pump body and a reduced convergent marginal free end which is received within the divergent throat thereby forming an annulus between the throat and the deflecter. The annular area increases in an outward direction respective to the nozzle. The power fluid exits from the nozzle and enters the inlet of the venturi causing produced fluid to be pulled into the throat entrance. The mixed fluids continue to flow through the throat and about the deflecter and out of the venturi as the fluids are forced to continue through the pump and then to the surface of the earth. The deflecter causes the power fluid to act against a greater surface area thereby utilizing all of the power fluid to its maximum advantage.

6 Claims, 6 Drawing Figures

DOWNHOLE JET PUMPS

PRIOR ART

Brown U.S. Pat. No. 3,781,134; McArthur et al U.S. Pat. No. 3,653,786; Coberly U.S. Pat. No. 2,812,723; Coberly U.S. Pat. No. 2,682,225; Wolff U.S. Pat. No. 2,041,803; Martin U.S. Pat. No. 1,845,675; Labadie U.S. Pat. No. 676,239.

BACKGROUND OF THE INVENTION

Jet pumps of the prior art are considered highly inefficient in comparison to other types of pumps. Jet pumps require a relatively high volume of power oil in order to vacuum pull the formation fluid into the pump venturi. As the power fluid exits the nozzle and enters the throat of the venturi, the energy of the fluid moving through the center of the throat rapidly dissipates in comparison to the movement of power fluid near the wall of the throat. Accordingly, the power fluid located at the center of the throat represents wasted energy in comparison to the power fluid located adjacent to the throat wall.

It is therefore desirable to be able to increase the efficiency of a jet pump apparatus by eliminating the wasted energy which occurs near the axial centerline of the venturi. It is further desired that the increased efficiency provide a greater production volume at a lower operating pressure. The realization of these desirable attributes is one of the objects of this invention.

SUMMARY OF THE INVENTION

This invention is related to various improvements in jet pumps, and in particular a jet pump having a concentrically arranged suction chamber, nozzle, venturi, and deflector. The suction chamber is formed about the nozzle and venturia inlet and is therefore connected to a formation fluid inlet so that when power fluid is forced to flow through the nozzle, the resulting stream of fluid entrains the formation fluid located within the suction chamber and mixed fluid flow occurs into the throat of the venturi.

The deflector is tapered in a direction towards the nozzle and a marginal free end thereof is mounted within the discharge opening of the throat thereby leaving an annular area between the outer wall surface of the deflector and the circumferentially extending inner wall surface of the venturi throat, this annular area outwardly increases. Produced fluid and spent power fluid therefore flow from the discharge opening to a produced fluid outlet of the pump where the comingled spent power fluid and the produced fluid are then forced to the surface of the earth. Hence, the deflector cooperates with the discharge opening of the throat and with the nozzle in a manner to significantly increase the efficiency of operation of a jet pump apparatus.

Accordingly, a primary object of the present invention is the provision of improvements in downhole jet-type pumps.

Another object of the present invention is the provision of apparatus in conjunction with a jet-type pump which eliminates axial flow through the discharge opening of a venturi throat associated therewith.

A further object of this invention is to disclose and provide a jet-type pump having apparatus associated therewith which provides for flow of power fluid through the nozzle and into the throat entrance whereupon the flow is then forced into an annular configuration thereby eliminating axial flow through the discharge nozzle throat.

A still further object of this invention is the provision of improvements in downhole jet-type pumps for producing oil wells.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
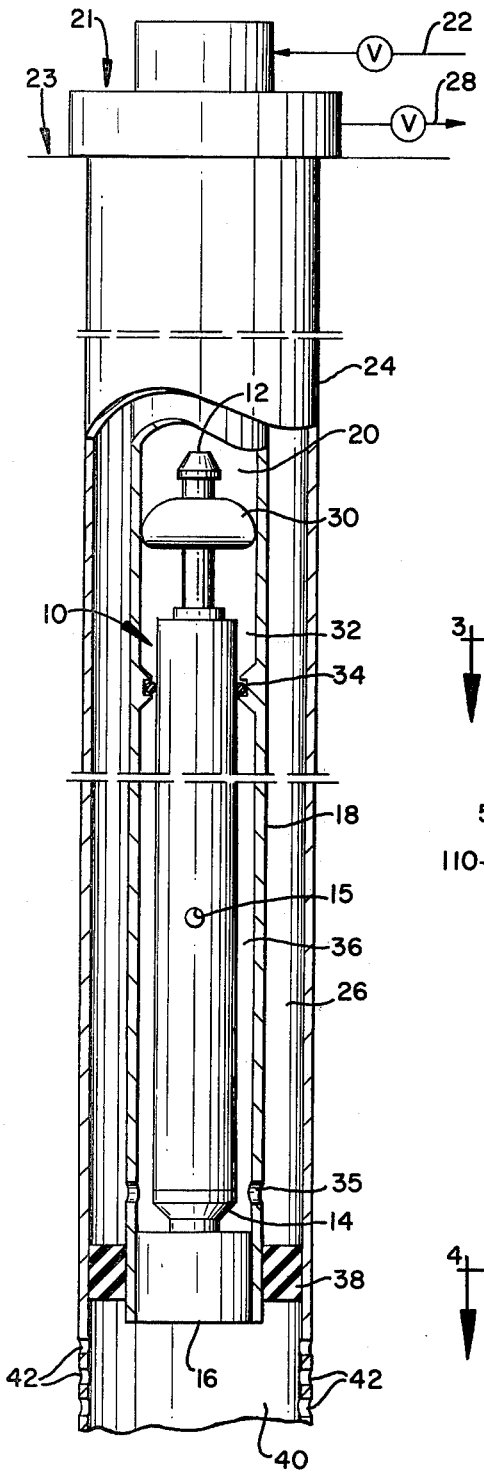
FIG. 1 is a broken, part cross-sectional representation of the present invention operatively disclosed in conjunction with a diagrammatically illustrated hydrocarbon producing wellbore.

FIG. 1 illustrates one embodiment of a jet pump 10 made in accordance with the present invention. The pump includes a power fluid inlet 12 at the upper end of the pump and a formation fluid inlet located at the opposed end 14 of the pump. Produced and spent power fluids are discharged through outlet port 15. Seating shoe 16 supportingly receives the lower end of the pump in the same manner of a conventional hydraulic pump and provides a formation fluid passageway thereinto.

Production tubing 18 conducts flow of fluid through the interior 20 thereof and is supported from a wellhead 21. A supply of power fluid flows through flowline 22 and into the interior 20 of the tubing. The wellhead is supported from the surface 23 of the ground. Well casing 24 is concentrically arranged respective to the tubing and forms annulus 26 therebetween through which produced fluid and spent power fluid can flow up the borehole and out of the Christmas Tree as indicated by numeral 28.

A packer nose assembly 30 separates annulus 32 from tubing interior 20 while seal ring 34 cooperates with the main body of the pump to separate annulus 36 from annulus 32. Ports 35 communicate annulus 26 and casing annulus 36 with one another. Packer device 38 anchors the lower end of the tubing string to the casing string and prevents flow between annulus 26 and lower casing interior 40. Perforations 42 communicate a pay zone or production formation with the casing interior 40, thereby providing a source of formation fluid at production inlet 48.

Figure 2:
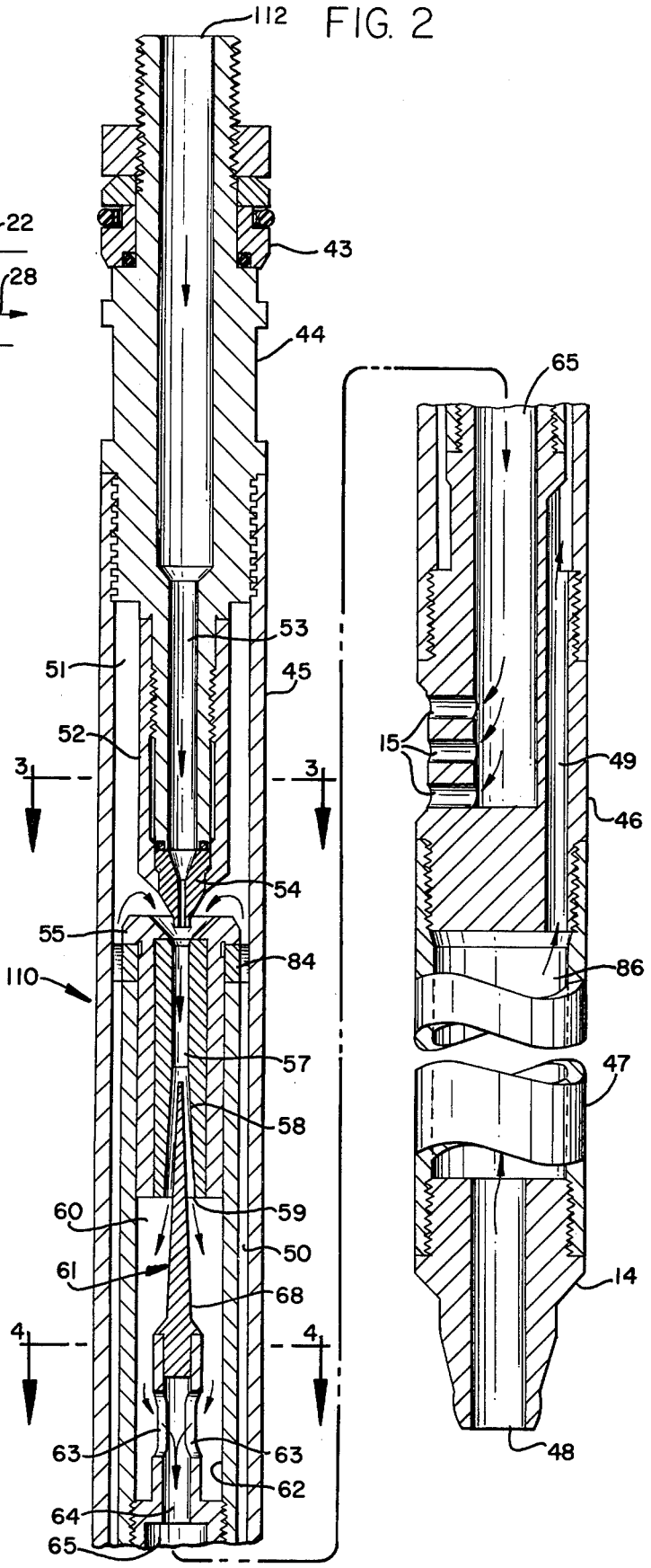
FIG. 2 is an enlarged, detailed, longitudinal cross-sectional representation of a downhole jet pump made in accordance with the present invention.
Figure 3:
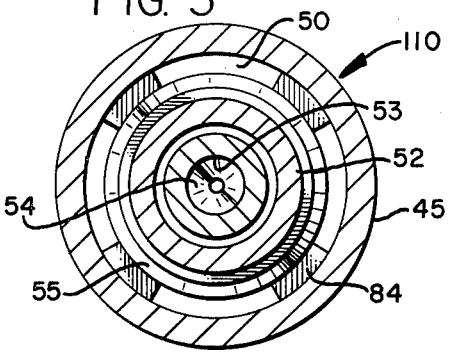
FIG. 3 is a cross-sectional view taken along line 3—3 of FIG. 2.
Figure 4:
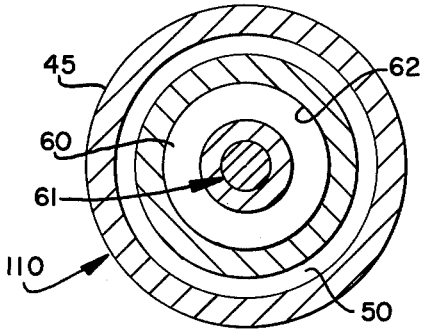
FIG. 4 is a cross-sectional view taken along line 4—4 of FIG. 2.

FIGS. 2–4 more specifically disclose the details of the pump 10. As may be appreciated from the disclosure seen in FIG. 2, the power fluid inlet 112 may be connected to a string of tubing (not shown) for a fixed type downhole pump 110, or alternatively, the pump of this invention can be of the free type, such as disclosed in FIG. 1. Numeral 43 indicates a circumferentially extending seal assembly which cooperates with the before illustrated seal ring to prevent flow there across. Upper sub 44 forms part of the main pump housing and is connected to a barrel 45 which in turn is connected to an outlet sub 46. Lower sub 47 is connected to sub 46 and receives lower pump end 14. The pump end can be received properly seated in a conventional shoe so that formation fluid is supplied to the production inlet 48.

Flow passageway 49 of the pump of FIG. 2 is connected to a pump annulus 50 which in turn is connected to suction chamber 51. Nozzle 52 is affixed to upper sub 44 and has a very hard metal alloy jet formed at the free end 54 thereof. The jet freely extends into the suction chamber and is spaced from venturi entrance of the venturi assembly 55 and from the interior wall of the barrel. Venturi throat 56 is concentrically arranged respective to the nozzle and barrel and extends axially away from the entrance as seen at 57 where the throat diverges at 58 and terminates at lower end 59. Discharge chamber 60 has a deflector 61 concentrically mounted therewithin with the lower enlarged end of the deflector being affixed to the interior wall 62 of the venturi assembly, thereby leaving a free tapered end of the deflector which extends axially uphole into the discharge portion 58 of the venturi throat. The venturi and deflector therefore jointly cooperate together in the illustrated manner of FIGS. 2–5 to form an annulus therebetween which is of varying cross-section. The ID 62 of the outer wall of the venturi assembly is spaced from the lower marginal end of the deflector. Port 63 communicates with axial passageway 64 formed in the lower marginal end of the interior of the deflector. Discharge chamber 65 communicates with the before mentioned port 15 to form a produced fluid outlet for the pump.

Figure 5:
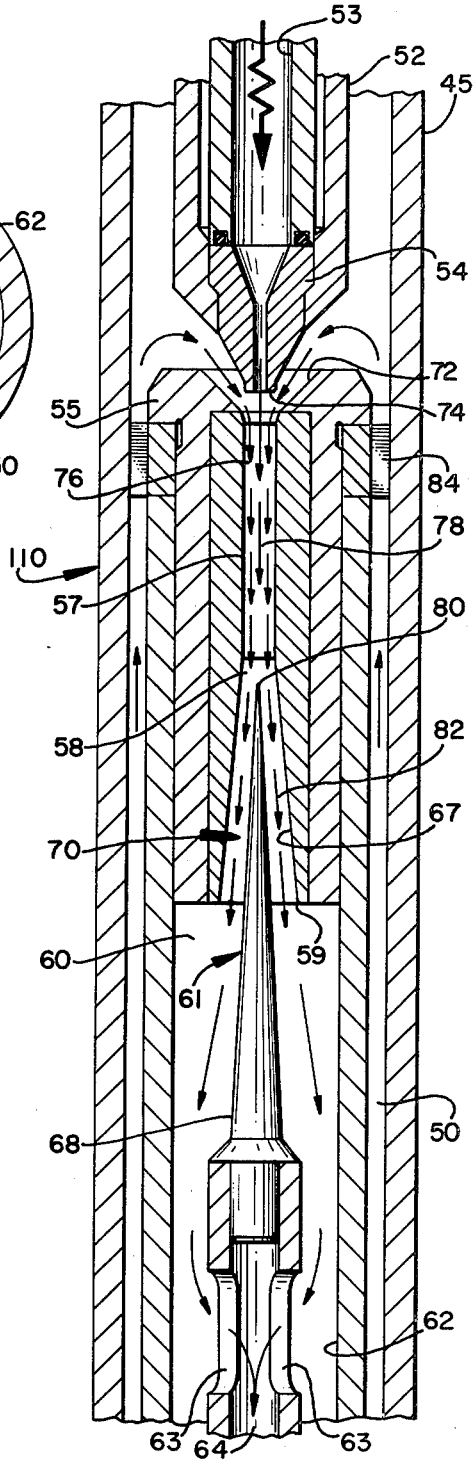
FIG. 5 is an enlarged, fragmentary, cross-sectional representation which sets forth additional details of the present invention; and, FIG. 6 is a detailed cross-sectional view of part of the before illustrated jet pump apparatus, with some parts being removed therefrom for the purpose of discussion of the theory of operation thereof.

As seen in FIG. 5, the venturi throat has a circumferentially extending wall surface 67 in the form of a cone which is spaced from a similarly tapered wall surface 68 of the deflector 61, thereby leaving an annular area 70 therebetween. The conicity of wall surface 67 and the taper of the deflector are of a slightly different angle so that the annulus therebetween increases in area, even with equal angles.

The venturi entrance 72 is spaced from the nozzle outlet 74 so that formation fluid is sucked from the suction chamber 51 due to the velocity of the mass flow at 74 and 76.

Numeral 76 indicates entrained fluid brought about by the suction of the high velocity stream 78. Numeral 80 indicates the outermost free reduced end portion of the deflector which causes the power fluid, spent power fluid, and produced fluid to assume a toroidal or annular flow path. At numeral 59 most all of the power has been extracted from the power fluid, and the comingled spent power fluid and formation fluid exits the venturi and enters the discharge chamber 60.

In FIGS. 2, 3, and 5, numeral 84 indicates spacer means by which the venturi assembly is maintained concentrically aligned respective to the outer barrel and the nozzle assembly. Numeral 86 of FIG. 2 is a production inlet chamber.

Figure 6:
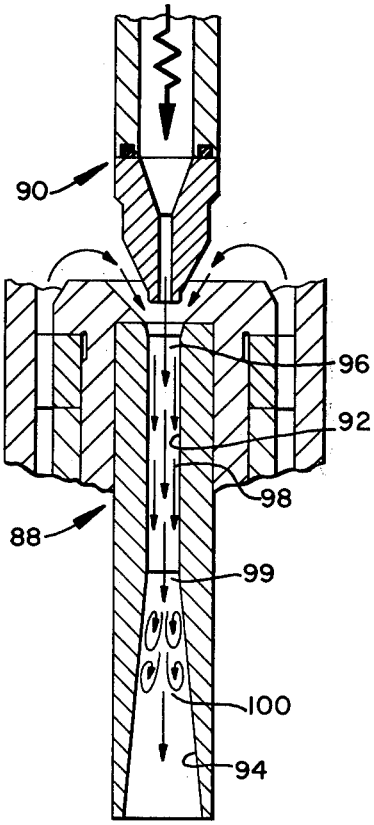

FIG. 6 discloses a jet pump venturi 88 spaced from a nozzle 90 with the deflector removed therefrom. The venturi throat 92 diverges at 94 in the before described manner. The jet of high pressure power fluid 96 sucks production fluid into the venturi throat, where the two fluids commence mixing at 98. Numeral 99 indicates that the two fluids have substantially mixed and the power fluid has therefore been spent, while numeral 100 indicates complete mixing of the two fluids. The central jet stream 96 is therefore effective over a very short distance as compared to the same stream 76 in the more efficient embodiment of FIG. 5.

In operation, as the power fluid moves into the entrance of the throat of the venturi, it commences to mix with the production fluid at 76, thereby sucking the production fluid from the suction chamber into the throat. The power fluid which remains adjacent to the axial centerline 78 of the throat ordinarily would be wasted energy in the absence of the deflector because it can not otherwise entrain any appreciable amount of the production fluid as noted in FIG. 6.

In order to move the power fluid from the relative inefficient central location 78 into more intimate contact with the produced fluid, the deflector is employed in the illustrated manner of FIG. 5. This expedient increases the friction drag of the power fluid against the production fluid, thereby further increasing the suction which draws additional production into the venturi.

Progressively increasing the area of the annulus commencing at the apex 80 of the deflector and continuing through the venturi into the suction chamber places the power fluid in more intimate contact with the produced fluid, thereby significantly increasing the efficiency of the jet pump. This enables a greater production volume to be achieved at a lower operating pressure.

I claim:

1. A jet pump for producing a well comprising a main body having an axial bore formed therethrough; a power fluid inlet connected to said axial bore at one end of said main body; means forming a produced fluid outlet for conducting fluid flow from the other end of said main body; a nozzle axially aligned with said main body and having a jet end spaced from an inlet end, a suction annulus formed between said nozzle and said main body, means by which said one end of said main body is connected to said power fluid inlet such that power fluid can flow into said one end, into said nozzle, and out of said jet end;

a formation fluid inlet connected to said other end of said main body, means forming a flow passageway which extends from the last said inlet into said suction annulus;

a venturi having a throat axially aligned with said nozzle, said throat having an inlet end and an outlet end, said inlet end of said throat being placed adjacent to said jet end of said nozzle;

a deflector means having a supported end and a free end extending away therefrom and received within the outlet end of the throat of the venturi, with there being an annular passageway formed between the deflector and the throat;

said venturi divides said axial bore into an upper chamber and a lower chamber; said nozzle being located in said upper chamber; said deflector means being located in said lower chamber; means by which said deflector means is supported within said lower chamber;

said annular chamber which is formed between said deflector and said venturi throat increases in cross-sectional area in a downstream direction; and, means connecting said produced fluid outlet to said lower chamber, including a passageway formed through a lower marginal end of said deflector and connected to the last said outlet.

2. The jet pump of claim 1 wherein said main body terminates in an upper sub, a packer nose assembly connected to said upper sub;

said power fluid inlet extends through said upper sub into communication with said nozzle;

an outlet sub at the lower end of said main body, a discharge chamber formed within said outlet sub, means forming a discharge port through which fluid can flow from said discharge chamber to a location externally of the pump;

a flow passageway formed from said discharge chamber to said discharge port.

3. A jet pump for producing a well comprising a main body having an axial bore formed therethrough; a power fluid inlet connected to one end of said main body; a nozzle axially aligned with said axial bore, means mounting said nozzle within said main body, said nozzle having a jet end spaced from an inlet end, a suction annulus formed between said nozzle and said main body, said inlet end being connected to said power fluid inlet such that power fluid can flow through said nozzle and out of said jet end;

a formation fluid inlet including means by which it is connected to another end of said main body, a flow passageway extending from the last said inlet into said suction annulus;

a venturi, means mounting said venturi in axially aligned relationship within said axial bore, said venturi having an inlet end and an outlet end, said inlet end of said venturi being placed adjacent to said jet end of said nozzle;

a deflector means having one end supported by said main body and a free end extending away therefrom and received within the throat of the venturi, with there being an annular passageway formed between the deflector and the throat;

said main body terminates in an upper sub; a packer nose assembly connected to said upper sub;

said power fluid inlet extends through said upper sub and into communication with said nozzle;

an outlet sub at the lower end of said main body, a discharge chamber formed within said outlet sub, a discharge port through which fluid can flow from said discharge chamber to a location externally of the pump; means connecting the last said annular passageway to said discharge port;

said venturi is located within a cylindrical chamber with the venturi closing the upper end of said cylindrical chamber;

said deflector has a lower end thereof supported by the lower end of said cylindrical chamber;

said means connecting the last said annular passageway to said discharge port includes a passageway formed through a lower marginal end of said deflector and to said discharge chamber.

4. A jet pump comprising: a main body having a power fluid inlet passageway, a formation fluid inlet passageway, and a production outlet passageway through which comingled spent power fluid and produced fluid may flow;

a suction chamber and a discharge chamber formed within said main body, means connecting said suction chamber to said formation fluid inlet passageway;

a nozzle including means by which it is mounted within said suction chamber, said nozzle having an inlet connected to said power fluid inlet passageway;

a venturi including means by which it is mounted within said main body, said venturi separates said suction chamber from said discharge chamber; a throat formed through said venturi, said venturi having an entrance and a diverging discharge opening, said throat being axially aligned respective to said nozzle, said nozzle outlet being located adjacent to said entrance;

a deflector having a fixed end opposed to a reduced marginal free end, said free end is elongated and progressively reduces in cross-section in an upstream direction; means mounting said fixed end to said main body with a marginal length of said free end being received within said throat in spaced relationship thereto thereby forming an annular discharge passageway thereabout which enlarges in cross-sectional area in a downstream direction; and means connecting said discharge chamber to said outlet passageway;

the lower marginal end of said deflector is hollow, means by which said produced fluid outlet is connected to the interior of said deflector, a port in said deflector connected to said discharge chamber for receiving flow from said annular passageway formed between the deflector and the throat.

5. The pump of claim 4 wherein said main body includes an inner barrel spaced from an outer barrel with there being an annular space formed therebetween which forms said formation fluid inlet passageway;

said main body terminates in an upper sub, a packer nose assembly connected to said upper sub;

said power fluid inlet extends through said upper sub into communication with said nozzle;

an outlet sub at the lower end of said main body, said discharge chamber being formed within said outlet sub, through which fluid can flow from said discharge chamber to said discharge port and to a location externally of the pump.

6. A jet pump comprising: a main body having a power fluid inlet passageway, a formation fluid inlet passageway, and a production outlet passageway through which comingled spent power fluid and produced fluid may flow;

a suction chamber and a discharge chamber formed within said main body, means connecting said suction chamber to said formation fluid inlet passageway;

a nozzle contained within said suction chamber, said nozzle having an inlet, means connecting said inlet to said power fluid inlet passageway;

a venturi means mounted within said main body such that said venturi separates said suction chamber from said discharge chamber, a throat formed through said venturi, said throat having an entrance and a diverging discharge opening, said throat being axially aligned respective to said nozzle, said nozzle including an outlet which is located adjacent to said throat entrance;

a deflector having a fixed end opposed to a reduced free end, said free end is elongated and progressively reduces in cross-section in an upstream direction; means mounting said fixed end to said main body with said marginal free end being received within said diverging discharge opening of said throat in spaced relationship thereto, thereby forming an annular discharge passageway thereabout which enlarges in cross-sectional area in a downstream direction; and means connecting said annular discharge passageway to said discharge chamber;

the lower marginal end of said deflector is hollow, said produced fluid outlet is connected to the interior of said deflector, and means forming a port in said deflector leading to said discharge chamber.

* * * * *